US007194784B2

(12) United States Patent
Overvaag et al.

(10) Patent No.: US 7,194,784 B2
(45) Date of Patent: Mar. 27, 2007

(54) FLOOR CLEANING APPARATUS WITH PIVOTAL HANDLE

(75) Inventors: Chad D. Overvaag, Danville, KY (US); James T. Crouch, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 520 days.

(21) Appl. No.: 10/759,502

(22) Filed: Jan. 16, 2004

(65) Prior Publication Data

US 2004/0261211 A1 Dec. 30, 2004

Related U.S. Application Data

(60) Provisional application No. 60/480,879, filed on Jun. 24, 2003.

(51) Int. Cl.
*A92L 9/24* (2006.01)
*A47L 9/32* (2006.01)

(52) U.S. Cl. ..... 15/410; 15/327.1; 285/7

(58) Field of Classification Search ..... 15/327.1, 15/334, 410; 285/7; *A47L 9/32, 9/24*
See application file for complete search history.

(56) References Cited

U.S. PATENT DOCUMENTS

| | | | | |
|---|---|---|---|---|
| 3,553,629 A | | 1/1971 | Brown | |
| 4,143,930 A | | 3/1979 | Schauer | |
| 4,188,801 A | | 2/1980 | Holden et al. | |
| 4,345,805 A | | 8/1982 | Finley et al. | |
| 4,550,957 A | | 11/1985 | Keane | |
| 4,550,958 A | | 11/1985 | Smith | |
| 5,884,358 A | | 3/1999 | Kim | |
| 5,927,758 A | * | 7/1999 | Carlsson | 285/7 |
| 6,695,352 B2 | * | 2/2004 | Park et al. | 285/7 |

FOREIGN PATENT DOCUMENTS

| | | | |
|---|---|---|---|
| DE | 198 43 973 | * | 7/1999 |
| EP | 0882 422 A1 | | 12/1998 |
| JP | 2001-061733 | | 3/2001 |

* cited by examiner

*Primary Examiner*—Theresa T. Snider
(74) *Attorney, Agent, or Firm*—King & Schickli, PLLC

(57) ABSTRACT

A floor care apparatus has a handle, connected to a hose, that pivots about an axis substantially perpendicular to a longitudinal axis of a terminal end of the hose. In this manner, the hose experiences less mechanical stress during use and, when embodied on a canister vacuum cleaner, a nozzle assembly connected to the handle has less tendency to tip over. Preferably, the hose has a cuff mounted at the terminal end with a hose insert therein. The hose insert has two stub shafts on opposing sides of an opening that form a journal defining the handle pivoting axis. The handle has two mating sections that clamshell about the journal and pinch it in place. Each mating section has a bearing surface for receipt of the journal and, when embodied as a cylinder, terminal ends of the journal become inserted therein.

18 Claims, 6 Drawing Sheets

FLOOR CLEANING APPARATUS WITH PIVOTAL HANDLE

This application claims the benefit of U.S. Provisional Patent Application Ser. No. 60/480,879 filed on Jun. 24, 2003.

TECHNICAL FIELD

The present invention relates generally to the floor care field, and, more particularly, to a floor cleaning apparatus, such as a canister vacuum cleaner, having a handle pivotally connected to a cleaning hose.

BACKGROUND OF THE INVENTION

Canister vacuum cleaners in all of their designs and permutations have become increasingly popular over the years. In general, canister vacuum cleaners incorporate a base assembly which rides on wheels and a nozzle assembly fluidly and mechanically connected thereto that sucks up dirt and dust by operator movement across a dirt-laden floor. Specifically, a rigid wand connects to the nozzle assembly and an operator manipulates a handle thereof back and forth to cause the wand, and thereby the nozzle, to sweep to and fro across the floor. In turn, the handle connects to a flexible hose that also connects to the base assembly.

Problematically, the connection between the handle and the hose typically involves rigid structures mechanically secured to one another that cause the hose to undergo large mechanical stresses whenever the handle moves relative thereto. As such, premature failure of the hose or the electrical conductors therein can result.

Accordingly, the floor care arts have need of a handle that can move relative to a hose without causing premature hose or other failures.

SUMMARY OF THE INVENTION

In accordance with the purposes of the present invention as described herein, an improved floor care apparatus is provided. The apparatus may take the form of a canister or an upright vacuum cleaner or may embody an extraction cleaning device or other hereinafter developed product having a hose connected to an operator handle.

In one embodiment, a floor care apparatus has a handle connected to a hose such that the handle pivots about an axis substantially perpendicular to a longitudinal axis of a terminal end of the hose. Preferably, the hose has a rigid cuff mounted at the terminal end with a hose insert therein. The hose insert has two stub shafts on opposite sides thereof that form a journal defining the handle pivoting axis. The handle has two mating sections that clamshell about the journal and pinch it in place. Each of the mating sections has a bearing surface for receipt of the journal and are embodied as cylinders. Terminal ends of the journal also embody cylinders and an inner diameter of the bearing surface cylinder is greater than an outer diameter of the journal cylinder terminal end so that the journal terminal end can be inserted into the bearing surface cylinder. During use, this arrangement lessens the mechanical stresses exerted on the hose when the handle moves relative thereto. Even further, when the floor care apparatus embodies a canister vacuum cleaner, a nozzle assembly thereof has less tendency to tip over during movement of the handle.

In the following description there is shown and described one possible embodiment of this invention, simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serves to explain the principles of the invention. In the drawings.

Reference will now be made in detail to the present invention, an example of which is illustrated in the accompanying drawing.

DETAILED DESCRIPTION OF THE INVENTION

Figure 1:
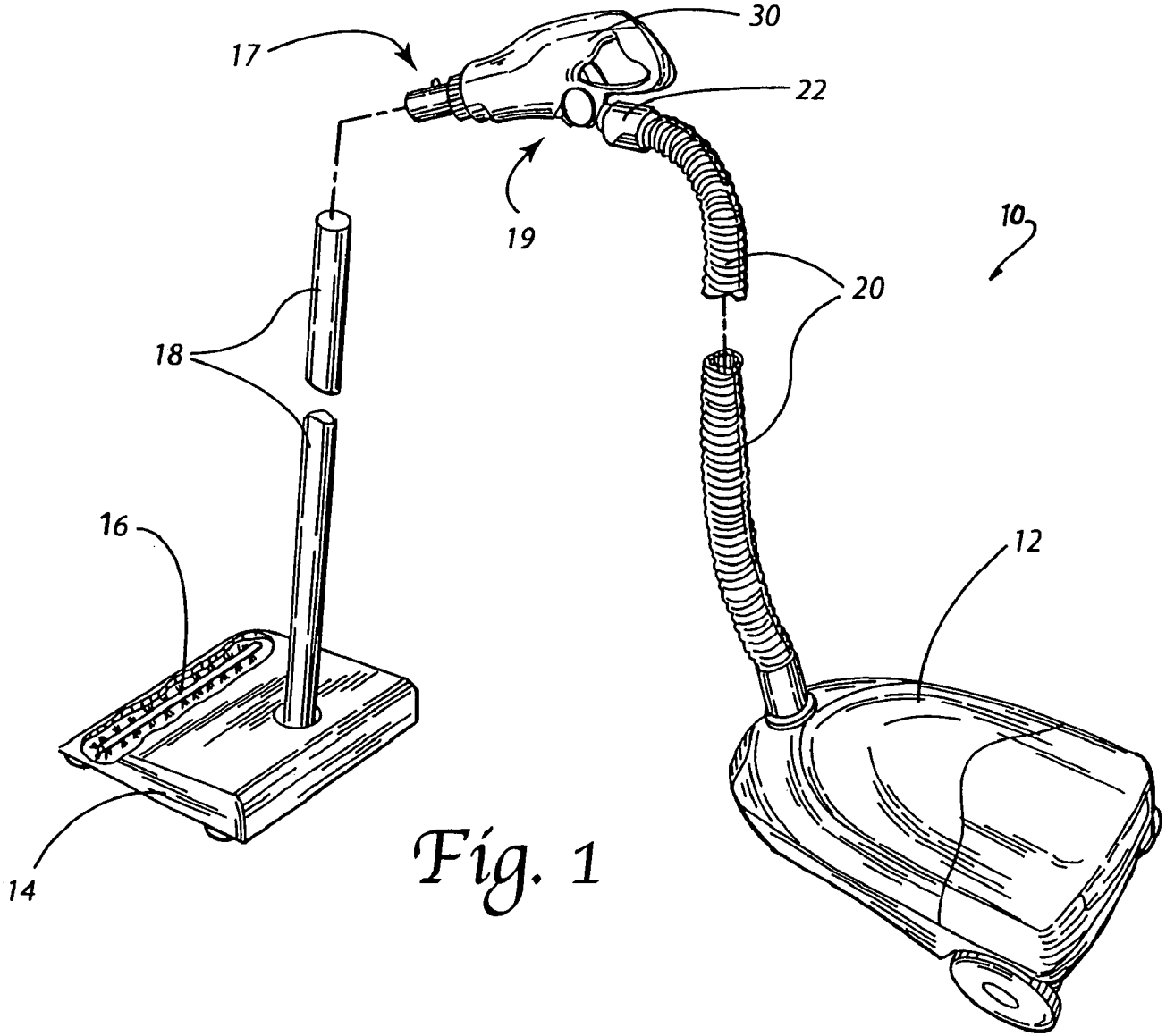
FIG. 1 is a perspective view of a floor care apparatus, in this instance a canister vacuum cleaner, constructed in accordance with the teachings of the present invention.

Reference is now made to FIG. 1 showing a floor care apparatus of the present invention. The apparatus illustrated exemplifies a canister vacuum cleaner 10 comprised generally of a base assembly 12 and a nozzle assembly 14. Although not shown, the base assembly contains a suction fan and motor that cooperates with an agitator 16 in the nozzle assembly for sucking up dirt and dust in a manner well known to those skilled in the art. A wand 18 mechanically and fluidly connects to the nozzle assembly and facilitates the sucking up of dirt and dust. In various embodiments, it may comprise a unitary, telescopic or connecting section of pipe, such as an aluminum pipe. Near the base assembly, a hose 20, flexible for user manipulation, connects thereto and likewise facilitates the sucking up of dirt and dust. In some embodiments, a cuff 22 formed of a rigid piece of plastic, metal or other occupies or mounts to a terminal end of the hose to provide a wieldy mechanical coupling region.

Finally, a handle 30 having at least two ends 17, 19 connects mechanically and fluidly to both the wand 18 and the hose 20 and/or cuff 22. As will be described in greater detail below, the handle of the present invention advantageously provides users the ability to rotate or pivot the handle about an axis substantially perpendicular to a longitudinal axis of the cuff and/or terminal end of the hose thereby reducing the mechanical stresses applied to the hose during use and reducing the tendency of the nozzle assembly to tip over.

Figure 2A:
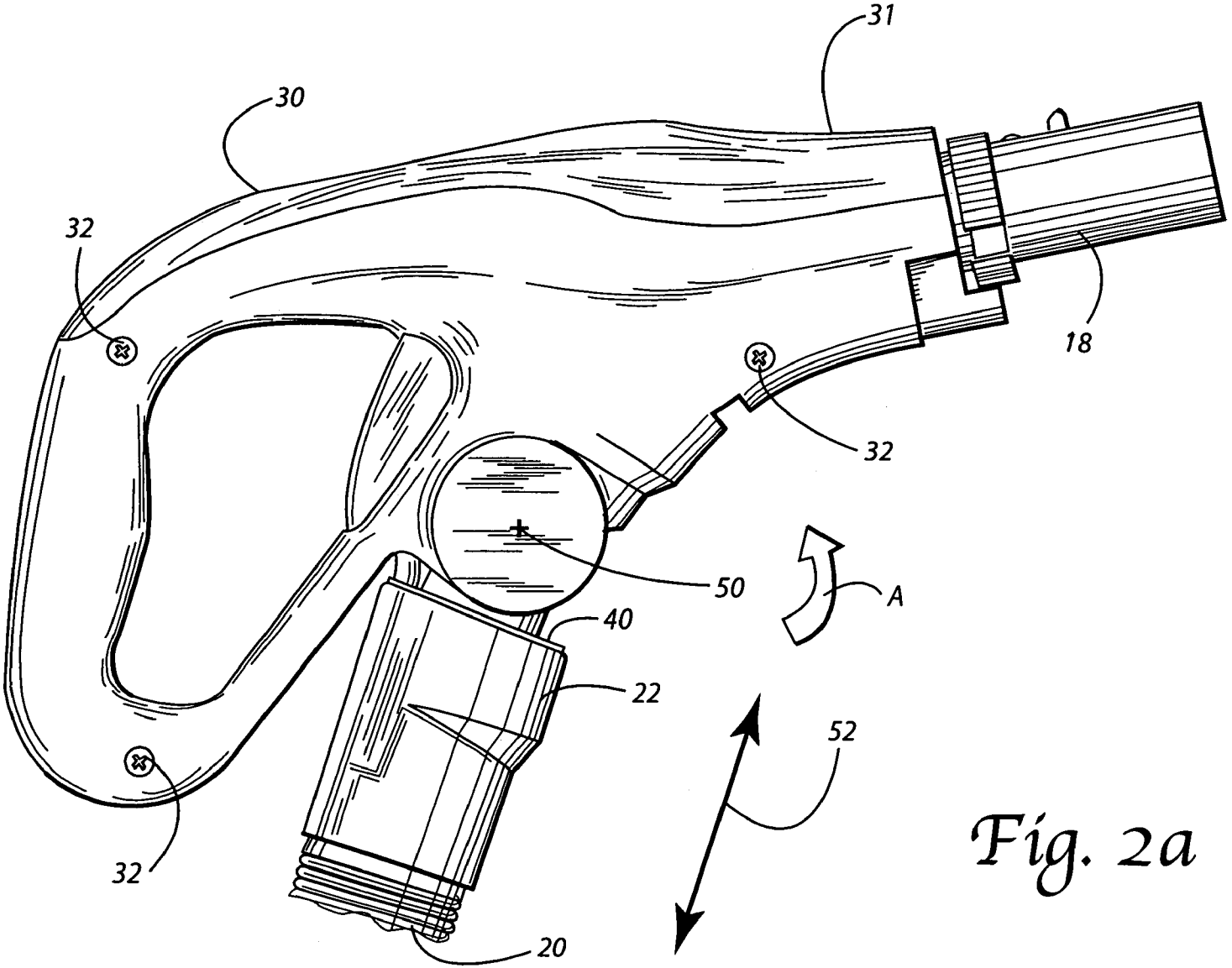
FIG. 2*a* is a side view of a cleaner handle having a wand-end pivoted upward relative to a hose.
Figure 2B:
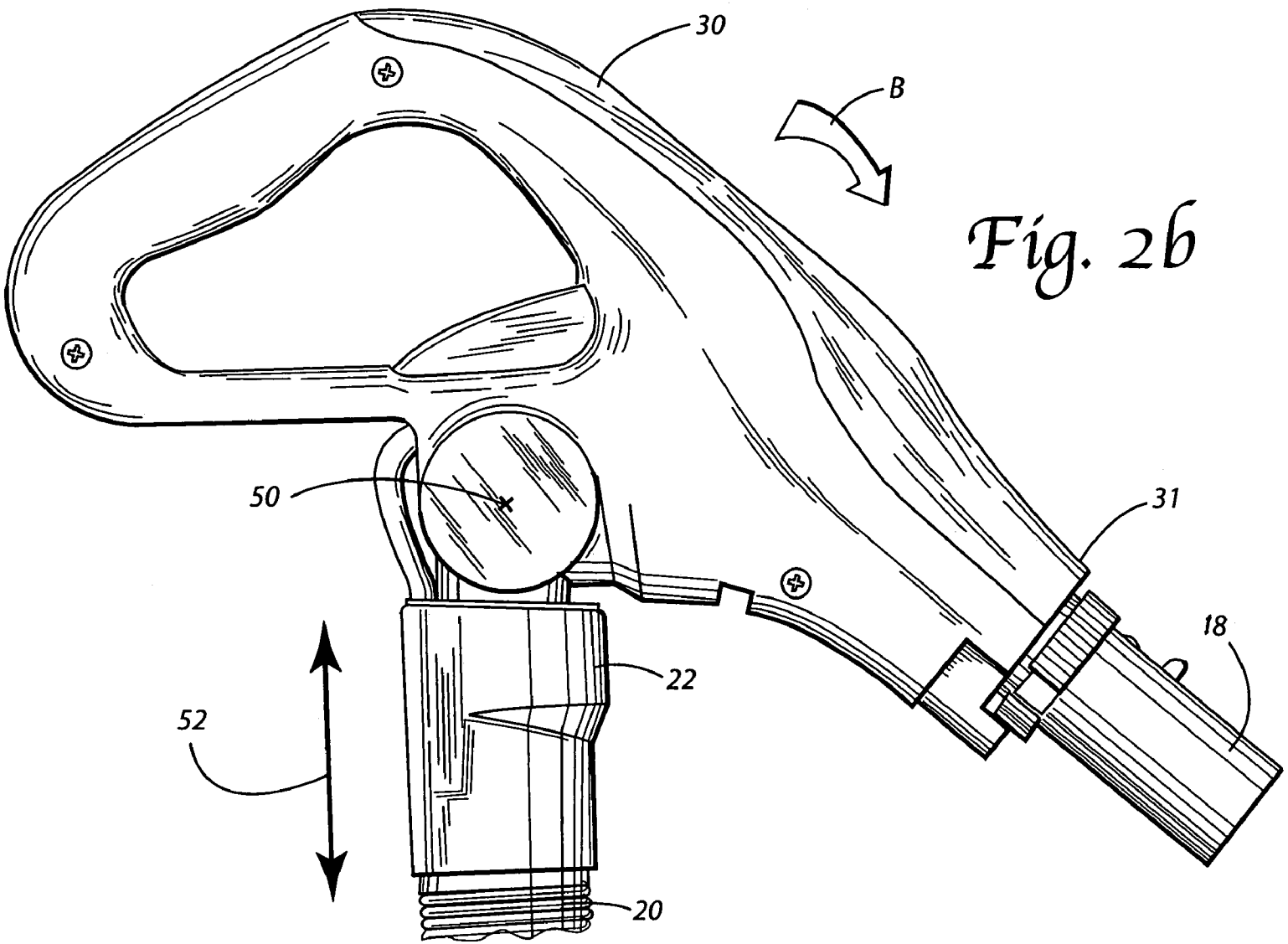
FIG. 2*b* is a side view of a cleaner handle having a wand-end pivoted downward relative to a hose.

By comparing FIG. 2*a* with 2*b*, skilled artisans will observe that a user may pivot the handle wand-end 31 upward relative to the hose 30 in the direction of rotation arrow A or downward relative to the hose 30 in the direction of rotation arrow B, respectively. Specifically, users may pivot the handle 30 about an axis 50 (shown generally in a direction into the paper) that, in turn, exists transverse to the longitudinal axis of a terminal end of the hose 20. As shown, an axis 52 represents an axis parallel the longitudinal axis of the terminal end of the hose. Since a cuff 22 occupies the terminal end of the hose in all the figures, the axis 52 also represents an axis parallel to the longitudinal axis of the cuff and the axis 50 exists transverse to all such axises. In a more preferred embodiment, the handle pivoting axis 50 exists substantially perpendicular to the longitudinal axis of the hose terminal end or the cuff.

Figure 3:
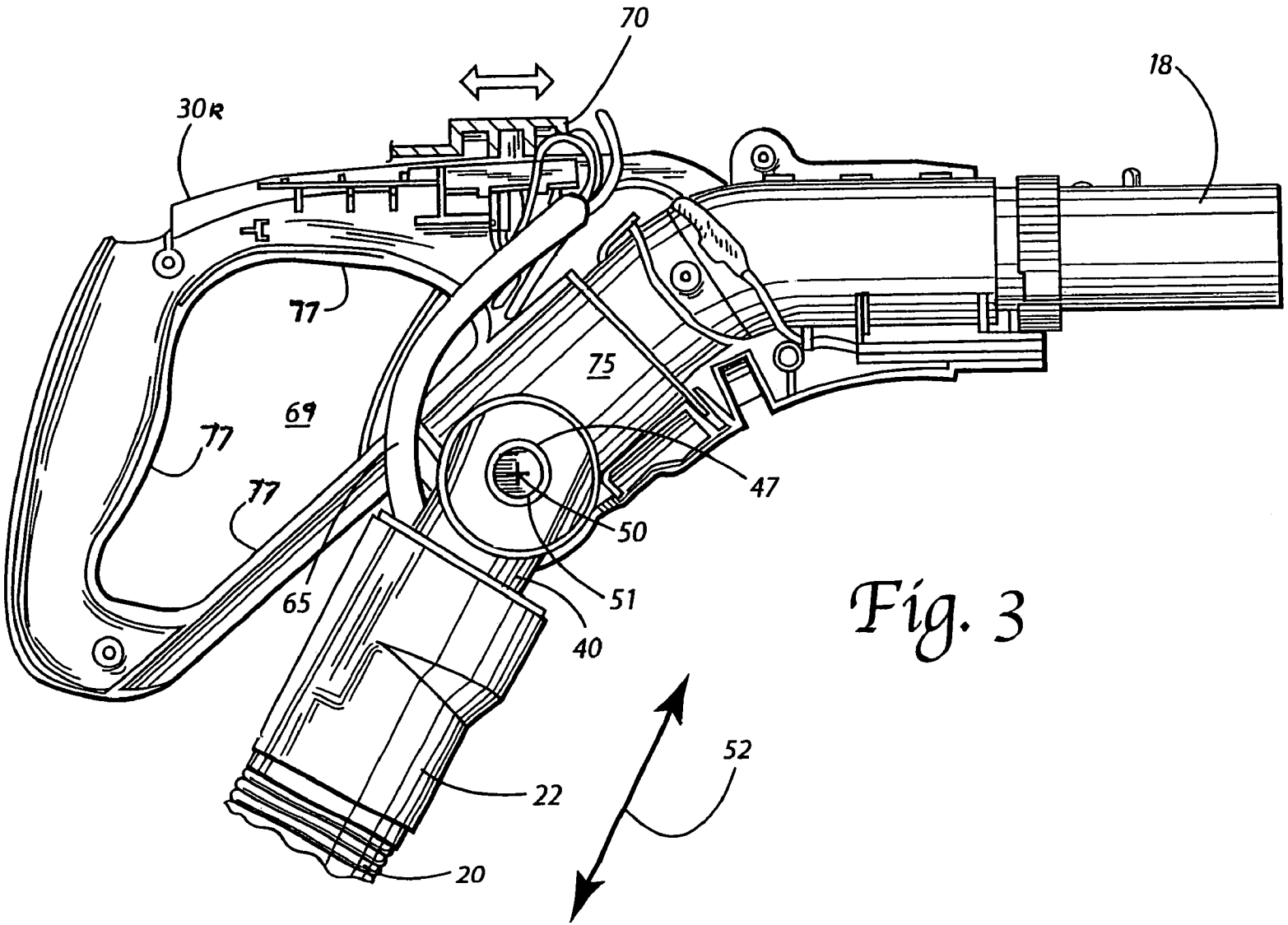
FIG. 3 is a side view of an interior of the handle connected to the hose.
Figure 4:
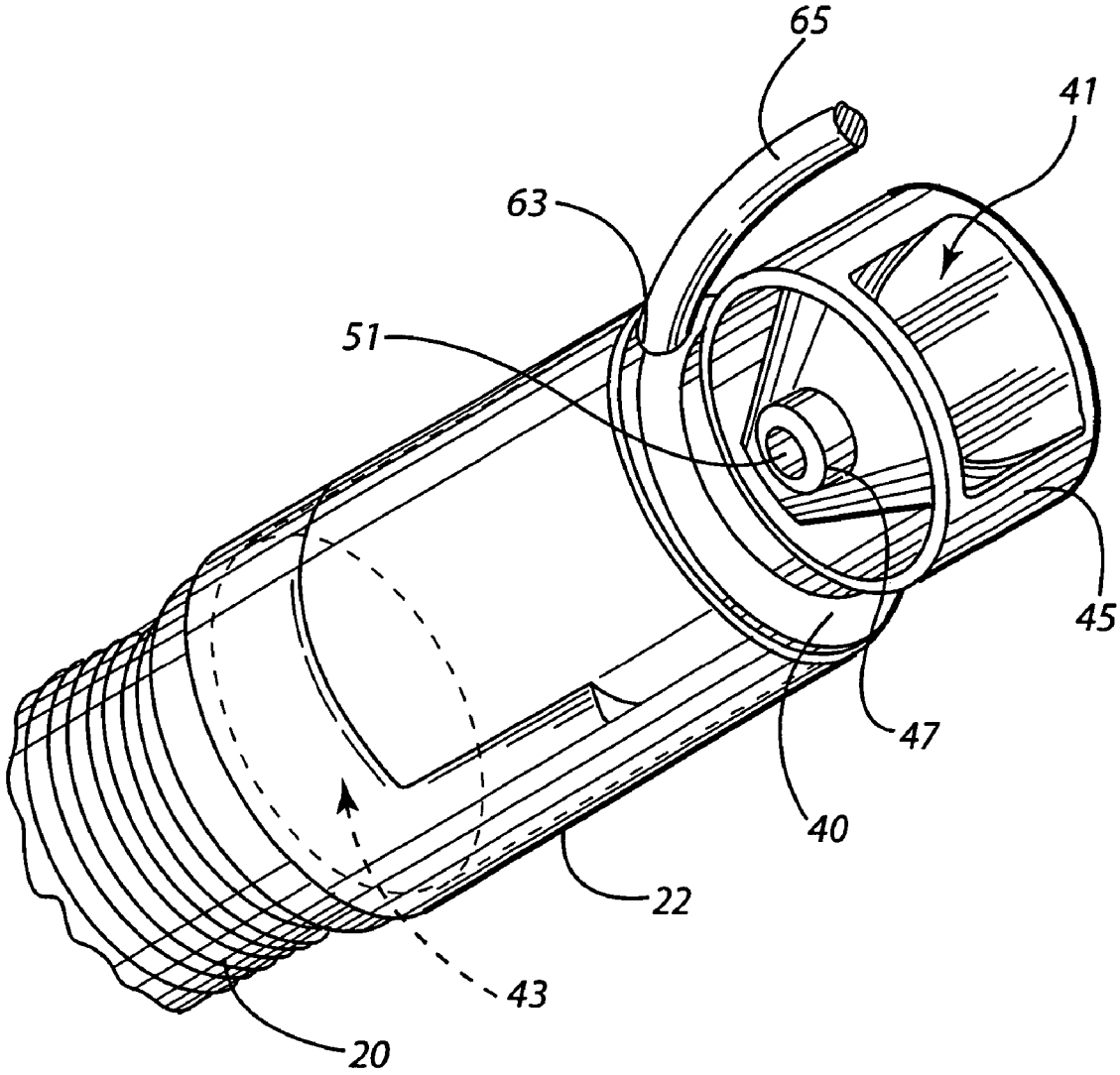
FIG. 4 is a perspective view of a cuff and a hose insert therein fitted at a terminal end of a hose.
Figure 5:
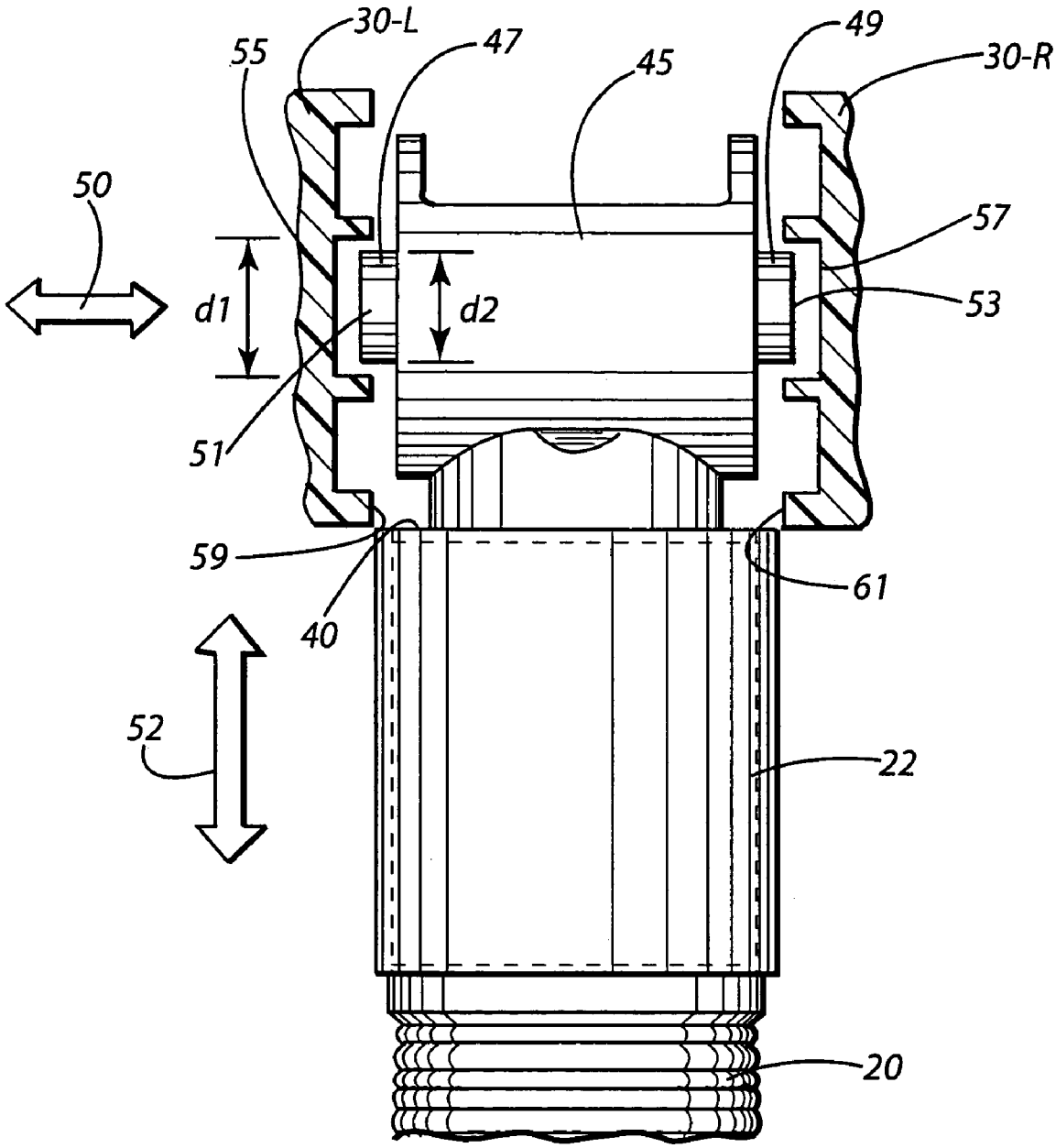
FIG. 5 is a side view of a journal of a hose insert before connection to bearing surfaces of a handle.

Appreciating that varieties of mechanical features will allow the described handle pivoting technique, refer now to FIGS. 3, 4 and 5 for a specific embodiment thereof. As before, a cuff 22 occupies a terminal end of the hose 20. A hose insert 40, having openings 41, 43 on either ends thereof to facilitate fluid communication between the base and nozzle assemblies, mounts to and resides within the cuff 22. In one embodiment, the mounting occurs as a result of a friction or an interference fit. In other embodiments, the mounting occurs as a result of mechanical fasteners holding the hose insert to the cuff or via welding or other.

Atop the hose insert 40 sits a cylinder 45 having two stub shafts 47, 49 emanating on opposite sides of the opening 41. Together, the two stub shafts form a journal along the axis 50 about which the handle will pivot. In a preferred embodiment, the terminal ends of the journal embody cylinders 51, 53 that become pinched between two corresponding larger-diameter cylinders 55, 57 on bearing surfaces 59, 61 of left and right mating sections 30-L, 30-R of the handle 30. Since the inner diameter d1 of the cylinders 55, 57 of the bearing surfaces exceeds the outer diameter d2 of the cylinder terminal ends of the journal 51, 53, the journal terminal ends easily fit within the cylinders when the two mating surfaces 30-L, 30-R are joined together. Preferably, the two mating sections join via mechanical fasteners, such as screws 32, rivets, clamps or the like, that extend through both mating sections and, when fastened, cause the mating sections to clamshell about the journal.

In addition, the hose insert 40 may contain a cutout region 63 to facilitate or accommodate an electrical wire 65, or other, that traverses generally the entirety of length of the hose 20 to provide an electrical connection between a power source (not shown) and an operator power or floor-setting switch 70.

In other embodiments, the journal of the hose insert may include a unitary shaft or axle that extends between both of the bearing surfaces of the handle and may or may not cross the opening 41. Alternatively, the shafts or axles may actually spin or turn relative to the hose insert instead of being stationarily mounted. Still alternatively, the axles or shafts may mount directly on the handle with the corresponding bearing surfaces existing on the hose insert. In other words, the journal and bearing surfaces may exist on either the hose insert or the handle and may be designed to interchange with one another.

In other handle embodiments, the two mating sections have interior walls that together define a flow conduit 75 to fluidly connect the hose insert opening 41 to the wand 18. Ultimately, this serves to fluidly connect the nozzle assembly to the base assembly.

In still other embodiments, a handle wall 77 defines an opening 69 for receiving an operator's hand during use and may or may not contain contours for receipt of individual fingers.

The foregoing was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. A floor care apparatus, comprising:

a hose for sucking up dirt and dust having a longitudinal axis at a terminal end thereof;

a handle connected to the terminal end that pivots about an axis transverse to the longitudinal axis; and a hose insert mounted within the terminal end having a journal defining the axis transverse to the longitudinal axis.

2. The floor care apparatus of claim 1, wherein the hose has a cuff mounted at the terminal end.

3. The floor care apparatus of claim 1, wherein the handle includes two mating sections each having a bearing surface, the bearing surfaces pinching the journal when the two mating sections are joined together.

4. A floor care apparatus, comprising:

a base assembly;

a flexible hose, having a longitudinal axis at a terminal end thereof; connected to the base assembly;

a nozzle assembly;

a wand connected to the nozzle assembly; and a handle connected to the wand and pivotally connected to the flexible hose such that the handle pivots about a journal defining an axis transverse to the longitudinal axis.

5. The floor care apparatus of claim 4, wherein the flexible hose has a cuff mounted at the terminal end.

6. The floor care apparatus of claim 5, wherein a hose insert mounts within the cuff.

7. The floor care apparatus of claim 6, wherein the hose insert includes the journal defining the axis.

8. The floor care apparatus of claim 7, wherein the handle includes two mating sections each having a bearing surface.

9. The floor care apparatus of claim 8, wherein the bearing surfaces pinch the journal when the two mating sections are joined together.

10. A canister vacuum cleaner, comprising:

a base assembly;

a flexible hose having a cuff and a hose insert therein connected to the base assembly, the cuff having a longitudinal axis and the hose insert having a journal defining an axis substantially perpendicular to the longitudinal axis;

a nozzle assembly;

a wand connected to the nozzle assembly; and a handle connected at one end to the wand and at another end pivotally connected to the journal such that the handle pivots about the axis substantially perpendicular to the longitudinal axis.

11. The canister vacuum cleaner of claim 10, wherein the hose insert has an opening in fluid communication with the nozzle assembly.

12. The canister vacuum cleaner of claim 10, wherein the hose insert has a cutout region facilitating a wire.

13. The canister vacuum cleaner of claim 10, wherein the handle has two mating sections each having a bearing surface, the bearing surfaces pinching the journal when the two mating sections are joined together.

14. The canister vacuum cleaner of claim 13, wherein one of the bearing surfaces includes a cylinder and the journal has a cylinder terminal end, an inner diameter of the cylinder being larger than an outer diameter of the cylinder terminal end.

15. The canister vacuum cleaner of claim 14, wherein the cylinder terminal end is inserted into the cylinder.

16. The canister vacuum cleaner of claim 13, wherein the two mating sections clamshell about the journal.

17. The canister vacuum cleaner of claim 10, wherein the journal embodies two stub shafts on opposite sides of the hose insert.

18. The canister vacuum cleaner of claim 17, wherein each of the two stub shafts insert into a cylinder of the handle.

* * * * *